219-121 SR
7/31/79 AR 4,162,914

United States Patent [19] [11] 4,162,914
Cremer [45] Jul. 31, 1979

[54] PROCESSES FOR MAKING HOLLOW METAL MICROBALLOONS AND THE PRODUCTS THEREOF

[75] Inventor: George D. Cremer, Lemon Grove, Calif.

[73] Assignee: International Harvester Company, Chicago, Ill.

[21] Appl. No.: 839,351

[22] Filed: Oct. 4, 1977

[51] Int. Cl.[2] ..... B22F 9/00
[52] U.S. Cl. ..... 75/0.5 B; 75/0.5 BA; 75/0.5 BB; 75/0.5 BC; 75/0.5 C; 75/251; 219/121 P
[58] Field of Search ..... 75/0.5 B, 0.5 BA, 0.5 BB, 75/0.5 BC, 0.5 C, 251; 219/121 P

[56] References Cited

U.S. PATENT DOCUMENTS

| | | | |
|---|---|---|---|
| 3,264,073 | 8/1966 | Schmitt | 75/251 |
| 3,466,166 | 9/1969 | Levinstein et al. | 75/0.5 B |
| 3,528,809 | 9/1970 | Farnand et al. | 75/0.5 B |
| 3,975,194 | 8/1976 | Farnand et al. | 75/222 |
| 4,076,640 | 2/1978 | Forgensi et al. | 75/0.5 B |

*Primary Examiner*—W. Stallard
*Attorney, Agent, or Firm*—Strauch, Nolan, Neale, Nies & Kurz

[57] ABSTRACT

A process for making hollow metal microballoons from alloys which include a base material capable of absorbing a gas when molten and then subsequently desorbing said gas during solidification and one or more glass formers. The alloy is melted and atomized in an inert atmosphere to form a clean, dense, unoxidized powder which is screened and then subjected to a reactive plasma, melting the particles and generating a gas which is absorbed in and inflates the particles. The gas desorbs from the microballoons as they solidify; and impervious, glassy films form on their surfaces.

21 Claims, 7 Drawing Figures

PROCESS FLOW DIAGRAM

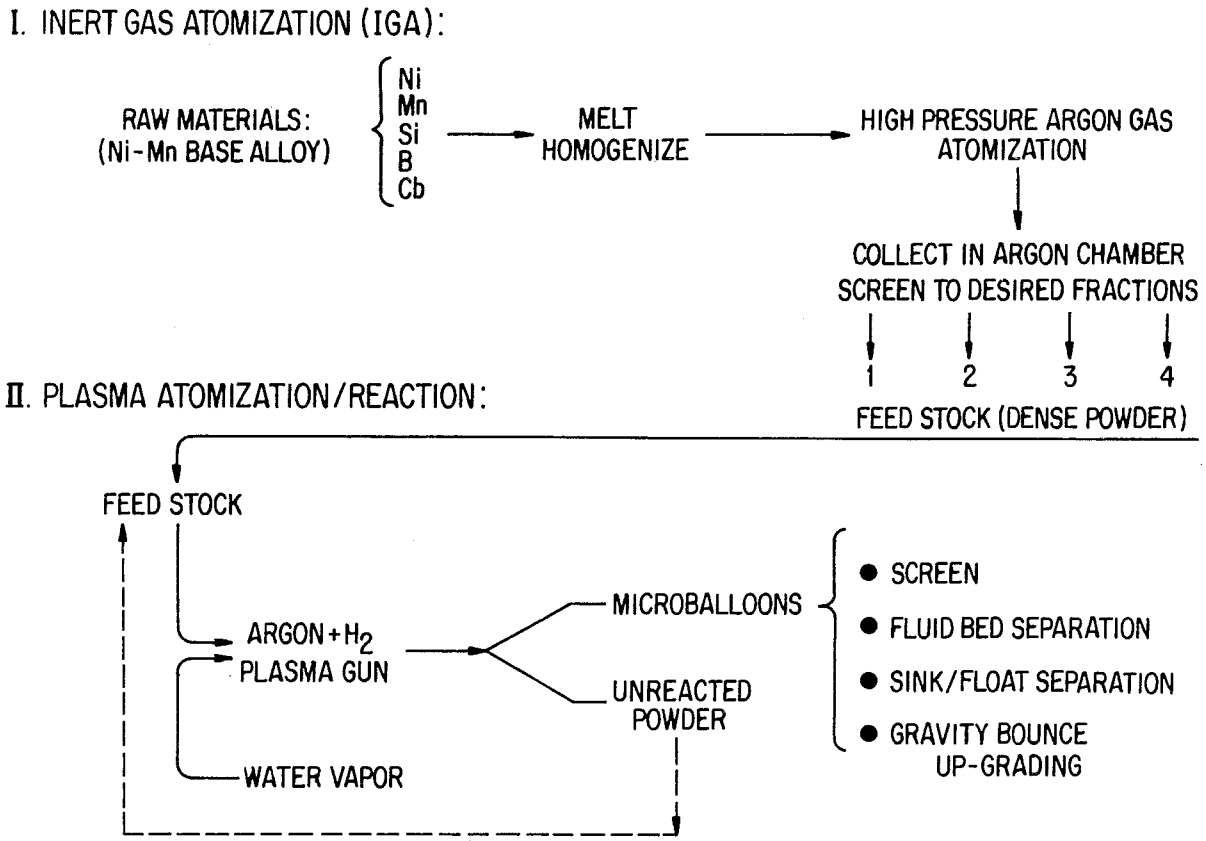
FIG. 1 PROCESS FLOW DIAGRAM

PROCESSES FOR MAKING HOLLOW METAL MICROBALLOONS AND THE PRODUCTS THEREOF

This invention relates to novel, improved processes for making impervious, hollow, metal microballoons which have high sphericity and thin walls of uniform thickness.

Such microballoons can be filled with deuterium and tritium and used as laser and electron beam targets for fusion reactions (see, for example, U.S. Pat. No. 3,940,617 issued Feb. 23, 1975, to Farnum et al).

In general, my novel process for making microballoons involves the formation of clean, unoxidized metallic powders followed by inflation of the particles in a plasma arc.

Preferably the metallic powders are prepared by melting selected elements into an alloy, atomizing the molten alloy, and cooling and collecting the particles formed in the atomization step, all under a protective atmosphere. This is followed by screening to eliminate oversize and undersize particles. This produces the feedstock which is subsequently inflated into microballoons.

A variety of alloys can be employed. It is necessary, however, that the base material of the alloy be a metal or combination of metals which is capable of absorbing hydrogen while in the molten state and of subsequently desorbing and expelling the hydrogen prior to and during solidification.

Also, the alloy must contain at least one glass former. This constituent reacts with oxygen made available in the process to form thin glass films on the surfaces of the inflated particles and thereby make them impermeable.

It is also necessary that the molten alloy have high fluidity in combination with a high liquid film rupture strength. The alloy must furthermore be one which undergoes minimal volume change and is favorable to the formation of a smooth surface topography during solidification. It should have a short solidification temperature range so that the walls of the microballoons will have a fine grain microstructure; and it should also be self-scavenging.

As suggested above, the metallic feedstock is fed into a plasma arc to reduce the particles to a molten state; and hydrogen and oxygen are also made available therein. This is preferably done by introducing water into the plasma. The water dissociates partially into nascent hydrogen and nascent oxygen.

It is hypothesized that the hydrogen is absorbed by the molten metallic particles. Subsequently, atomic hydrogen desorbs and/or becomes molecular hydrogen and inflates the particles as they cool; and available oxygen reacts with the glass former or formers in the alloy to form glassy coatings on the expanding hollow spheres.

The microballoons are permitted to fall by gravity onto a collector as they solidify and cool. Although they may be relatively fragile, they are so light in weight that free fall through the atmosphere will not damage them.

The novel process just described has the advantage that microballoons with diameters in the range of 50 to 1000 micrometers or in any wanted part thereof can be produced.

The microballoons characteristically have uniform 1 to 3 micron thick shells with smooth, shiny external surfaces, a high degree of sphericity, and comparatively high strength for their size and shell thickness.

Methods of making hollow metallic spheres, in some cases in micro sizes, have heretofore been proposed. The most common of the prior art techniques involves the coating of a spherical core followed by removal of the latter. U.S. Pat. No. 3,135,044 issued June 2, 1964, to Mote et al; U.S. Pat. No. 3,264,073 issued Aug. 2, 1966, to Schmitt; U.S. Pat. No. 3,268,304 issued Aug. 23, 1966, to Vaught et al; U.S. Pat. No. 3,347,798 issued Oct. 17, 1967, to Baer et al; U.S. Pat. No. 3,371,405 issued Mar. 5, 1968 to Klibanoff; U.S. Pat. No. 3,528,809 issued Sept. 15, 1970, to Farmand et al; and U.S. Pat. No. 3,674,461 issued July 4, 1972, to Farnand et al disclose processes of that character.

The type of process described in the preceding paragraph has a number of disadvantages including complexity. Also, the necessity of removing a core through the wall of the sphere leads to a lack of gas tightness and non-uniformity especially in the variations exemplified by Vaught et al U.S. Pat. No. 3,268,304 and Baer et al U.S. Pat. No. 3,347,798 which involve an actual rupture of the sphere.

It has also been suggested (see, for example, U.S. Pat. No. 2,985,411 issued May 23, 1961, to Madden) that metal spheres be made by welding two hemispheres together.

This is obviously impractical where the goal is spheres of micro size.

U.S. Pat. No. 3,738,824 issued June 12, 1973, to Davis et al and U.S. Pat. No. 3,909,241 issued Sept. 30, 1975, to Cheney et al involve processes which superficially resemble mine in that they involve the feeding of a finely divided metallic powder through a plasma arc. However, the processes are otherwise not alike; and the end products are different—solid particles instead of microballoons.

From the foregoing it will be apparent to the reader that one important and primary object of the present invention resides in the provision of novel, improved, metallic microballoons.

Other important but more specific objects of the invention reside in the provision of microballoons in accord with the preceding object:

which have diameters in the range of 75 to 1000 microns and shell thicknesses in the range of one to three microns;

which have uniform thickness shells and surfaces with minimal surface imperfections;

which have metallic shells overlaid with a thin, impermeable glassy coating;

which are made from metallic alloys that contain at least one glass former and a base material capable of absorbing hydrogen when the alloy is molten and of subsequently desorbing the hydrogen;

which are made from alloys that have a short temperature solidification range, that undergo minimal volume change upon solidification, and that have high fluidity combined with high liquid film strength.

Another important and primary object of the invention resides in the provision of novel, improved processes for making microballoons.

A related, primary, and important object of the invention resides in the provision of processes for making metallic microballoons having the characteristics identified above.

Other related and important but more specific objects of the invention reside in the provision of novel, improved processes for making microballoons:

which produce microballoons in a size between about 50 and 1000 microns;

which are capable of producing metallic microballoons with the desirable characteristics listed above;

which can be employed to produce metallic microballoons usable as targets for laser and electron beam-initiated fusion reactions;

which involve the formation of metallic powders having particles of a controlled size followed by inflation of the particles into hollow metallic spheres in a plasma arc;

in which, in conjunction with the preceding object, hydrogen and oxygen are made available in the arc plasma to respectively inflate the metallic particles and to react with one of more glass formers present in the alloy and form thin glassy coatings on the inflating, spherical particles.

Other important objects and features and additional advantages of the invention will become apparent from the appended claims and as the ensuing detailed description and discussion proceeds in conjunction with the accompanying drawing, in which:

FIG. 1 is a flow diagram of my novel method for producing hollow, metallic microballoons;

Figure 7:
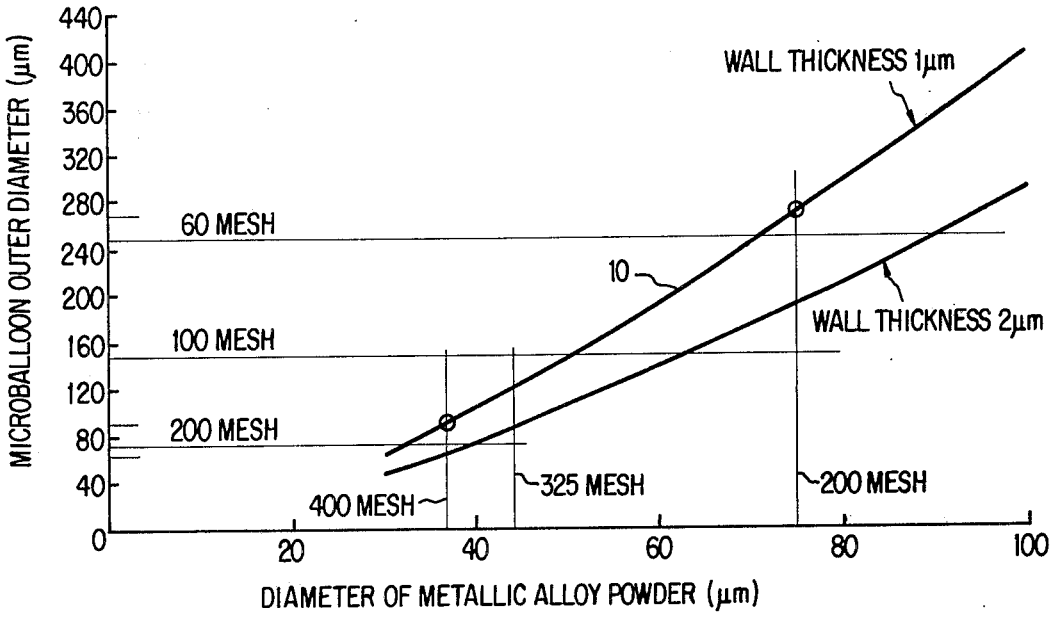
FIG. 7 is a graph showing the relationship between metallic alloy particle size and the diameter of the microballoons produced therefrom.

Microballoons in accord with the principles of the present invention can be made from a variety of metallic alloys.

The essential characteristics of the alloy are that it must include at least one glass former and a base material which is capable of absorbing hydrogen when the alloy is molten and of desorbing and expelling hydrogen as the alloy cools and solidifies. Also, the alloy is preferably one which undergoes minimal volume change as it solidifies; and the alloy must preferably have a short temperature solidification range and possess high fluidity and a high liquid film strength. It is also thought that the glass former should have a free energy of formation per gram-atomic weight of oxygen which is lower than that of hydrogen per gram-atomic weight of oxygen.

Preferred glass formers include boron and silicon. Other glass formers that may be used are phosphorous, arsenic, and germanium compounds. Mixtures of the foregoing can also be used.

Typical alloys will have a glass former content of 3.5 to 4.2 percent based on the total weight of the alloy. This range will be varied, however, depending upon the remaining constituents of the alloy. The critical factor is that the glass former or formers be present in sufficient amount to produce a thin (e.g., 100 Angstrom) but integral film or coating on the surface of the hollow metallic spheres produced in the process.

The preferred base materials are nickel-manganese alloys, especially those containing from 68–76 percent nickel and from 21–27 percent manganese. However, manganese is not believed to be an essential constituent of the base material although it is thought to desirably influence the hydrogen absorbing capability of the base material. I do therefore not intend to limit the processes and compositions defined in the appended claims to the use of that element except to the extent that it is expressly called for therein.

From a trace to 0.5 percent of columbium is also preferably included in the alloy with the base material and the glass former(s). This makes the alloy self-scavenging with respect to carbon and nitrogen under the process conditions, an attribute I consider highly desirable, if not essential, to the successful practice of my novel process.

Other elements may also be included in the feedstock alloy to enhance its capacity for forming microballoons with the wanted characteristics. Among these are iron, cobalt, chromium, aluminum, beryllium, and molybdenum.

Rare earth metals such as cerium or mischmetal can also be added to the feedstock alloy to improve its self-scavenging capability. In general, however, I prefer to avoid the addition of rare earth metals as they tend to scum up and decrease the fluidity and liquid/solid wetting characteristics of the feedstock alloy.

The preferred feedstock alloys are those having the following formula:

| Element | Percent by Weight |
|---|---|
| Ni | 68–76 |
| Mn | 21–27 |
| Si | 2.4–3.2 |
| B | 1.1–1.4 |
| Cb | trace–0.5 |

The proportion of boron employed in the feedstock alloy is perhaps the most critical of those tabulated above as amounts greater than the indicated maximum of 1.4 percent produce an unsatisfactory level of brittleness in the alloy. Alloys with less than the specified minimum amount of boron tend to have unsatisfactorily wide solidus/liquidus spreads with correspondingly sluggish flows.

In the particular nickel-manganese based alloys covered in the tabulation, lower than specified amounts of manganese also result in undesirably wide solidus/liquidus spreads and are therefore preferably avoided. Reducing the silicon content below the specified minimum level does not appear to appreciably change the solidus/liquidus spread but nevertheless undesirably affects the flow characteristics of the alloy. Similarly, larger than indicated amounts of the columbian scavenger result in feedstock alloys with sluggish flows.

Of the alloys embraced within the tabulated formulation, those of the nominal compositions Ni-21.0Mn-2.4Si-1.4B-trace Cb and Ni-24.0Mn-2.8Si-1.4B-trace Cb are preferred. Both have high liquid film strength, excellent fluidity, and the ability to inflate rapidly; and neither undergoes more than a minimum volume change when it solidifies which appears to be uniquely favorable for microballoon stabilization. Also, both alloys have low microporosity and a high self-scavenging capability with respect to carbon, nitrogen, oxygen and sulfur, the chief contaminants in feedstock alloys of the character described above.

Referring now to the drawing, FIG. 1 shows schematically the steps employed in making hollow, metallic microballoons in accord with the principles of the present invention.

The initial phase of the novel process for preparing metallic microballoons disclosed herein involves the formation of a finely divided metallic feedstock from an alloy of the character described above.

The first step in forming the feedstock is to melt the alloy or alloy constituents. Preferably, the metallic material or materials are melted in an aluminum oxide crucible using induction heating in a chamber containing purified argon.

The molten alloy is then atomized by spraying it from a nozzle, preferably using purified argon as a propellant. This yields a dense powder having a particle size primarily in the range of 100 to 400 mesh.

The particles produced by the atomization step are collected and cooled, preferably in a chamber filled with purified argon. This ensures that a clean, unoxidized powder is obtained.

The metallic powder thus obtained is screened, typically using a Denver Equipment Company vertical hanging frame with a gyratory action of 865 rpm and sieves with appropriate mesh sizes.

One purpose of screening the powder is to restrict it to particle sizes in a specified range. This is because the diameters of the microballoons into which the particles can be converted are directly related to the particles sizes as shown in FIG. 7.

For example, microballoons of desirable size for the application discussed above can be made by removing from the feedstock particles having a size less than 400 or greater than 200 mesh (34 to 74 micrometers). As shown by curve 10 in FIG. 7, the remaining particles can be converted into microballoons with a wall thickness of one micron and diameters in the range of 90 to 270 micrometers. This has been a desirable size range for electron beam and laser fusion targets. Larger diameter particles up to 1000 micrometers have been produced by correspondingly coarser feedstock powder.

A second function of screening the powder produced in the atomization step is to eliminate fines (−625 mesh particles) from the powder. The presence of such particles is undesirable because they act as nucleation sites for the formation of unwanted, alien appendage structures in the microballoons.

Figure 3:
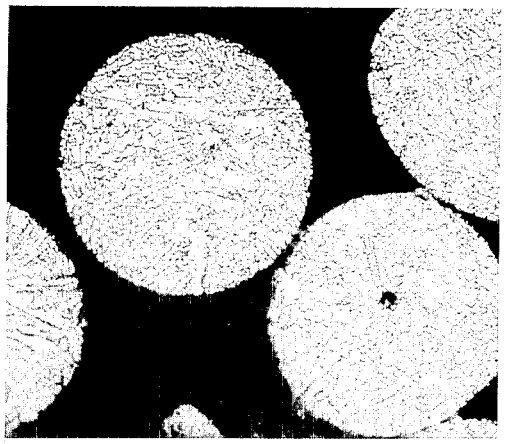
FIG. 3 shows in cross-section dense metallic particles produced by, and inflatable into microballoons in accord with, the principles of the present invention (1000× magnification)

Typical particles of feedstock material produced in the manner discussed above are shown in FIG. 3.

In the second phase of the novel process disclosed and claimed herein, the feedstock particles are inflated into the end product microballoons. This is accomplished by melting the particles in a plasma arc and in the presence of a gas such as nascent hydrogen which is absorbed into the particles to inflate them. Concurrently, oxygen made available in the environment of the molten particles reacts with the glass former or formers present in the feedstock alloy to form thin glassy films on the surfaces of the inflating particles.

Also, the slags formed by the scavenging elements in the feedstock alloy and the contaminants with which they react apparently migrate to the surface of the expanded, spherical particles, there combining with the glass forming reaction products.

Figure 4:
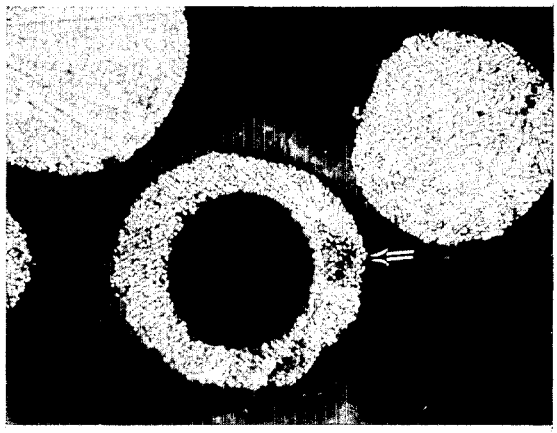
FIG. 4 is a section through a partially inflated particle (1000× magnification)

FIG. 4 shows a partially inflated feedstock particle. The wall of the particle is still relatively thick (10–15 micrometers), and the particle has increased very little in diameter as can be seen by comparing it with the unexpanded particles shown in the same Figure.

This demonstrates that thinning of the particle walls and expansion in diameter occur only near the end of the inflation cycle, making it evident that the feedstock alloy must have high fluidity and that it must be capable of retaining this fluidity to the end of the inflation cycle.

The preferred technique for introducing nascent hydrogen and oxygen into the environment of the feedstock particles is to introduce water into the plasma arc. At the temperatures existing in plasmas, water is largely dissociated into atomic hydrogen and oxygen.

It is nevertheless not critical that this particular approach be employed; and the oxygen and hydrogen or other particle inflating gas may be otherwise supplied, if desired.

The inflated particles exiting from the plasma arc are preferably permitted to follow a free trajectory through air in order to minimize denting and other damage as and after they cool and the alloy and glassy film solidify.

The resulting microballoons are collected and preferably screened to eliminate over and undersize microballoons and unexpanded particles.

Figure 5:
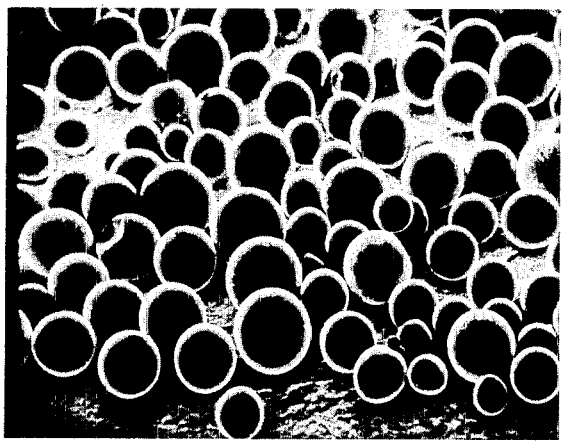
FIG. 5 shows a group of microballoons produced in accord with the principles of the present invention (54× magnification)
Figure 6:
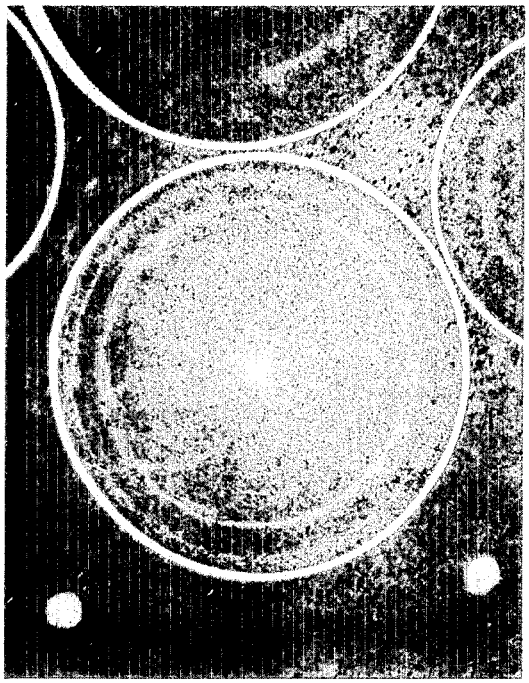
FIG. 6 is a section through a microballoon produced in accord with the principles of the present invention.

Metallic microballoons produced by the novel process just described are shown in FIG. 5. FIG. 6 is a section through an essentially perfect microballoon produced by the process.

Figure 2:
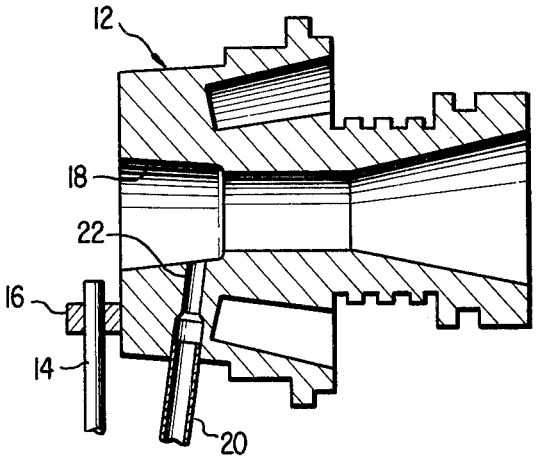
FIG. 2 is a section through the nozzle of a plasma gun which is employed in the process shown in flow diagram form in FIG. 1.

The plasma generator employed in the inflation step is not critical. One system which may be used is a Metco type 2 MR plasma generator with a 2 MC console, a type 3 MB gun, a #3 MP Powder feeder, and a #3 M7-GH nozzle. The nozzle is shown in FIG. 2 and identified by reference character 12.

The particulate feedstock is propelled by a separate argon source into the plasma through a tube 14 supported from the nozzle by a bracket 16. Tube 14 has a 0.07 inch inside diameter and discharges the powder directly up into the plasma flame. The outlet from the tube is 0.18 inch in front of the nozzle and 0.3 inch below the nozzle centerline.

The pure water constituting the source of atomic oxygen and hydrogen for the inflation process is introduced into the bore 18 of nozzle 12 through a tube 20 and a passage 22 communicating between the tube and bore 18, typically at a rate of 0.6 cubic centimeters per second.

In a typical application nozzle 12 is oriented horizontally and approximately 3.5 feet above floor level. Microballoons and unreacted particles are collected on wrapping paper laid out on the floor after falling by gravity from the plasma arc onto the paper.

The collected particles are upgraded using the Denver Equipment system discussed above and/or flotation separation using distilled water plus a detergent in a 500 to 1 ratio or a mixture of ethyl, methyl, and isopopyl alcohols.

The quality of the microballoon product can also be upgraded by what I term an "elastic-bounce method." In this method the microballoons are bounced in a high vaccum off a planar, beryllium, mirror surface. Perfect and near-perfect microballoons bounce farther, straighter, and higher than balloons which are aspherical or have defective wall structure.

In addition to the foregoing techniques, fluid bed separation can be employed to grade the particles as indicated in FIG. 1.

The process will typically produce about 10–25 percent microballoons by weight. The uninflated particles can be recycled.

Notwithstanding the properties of the feedstock alloys, the microballoons made by the novel process described above are relatively susceptible to damage. This can be minimized by reducing high energy collisions and friction between the microballoons. For example, resilient, low-modulus plastic containers and sizing screens rather than metal or glass components can be used.

The quality of the product can also be upgraded by heat treating the feedstock in vacuum. This will effectively minimize alien structures present in the inflated particles.

As indicated above, hydrogen does not have to be employed to inflate the microballoons. Other gases may be used for this purpose including dissociated carbon monoxide, oxygen, and nitrogen. However, the gas must be one which will not react deleteriously with the feedstock alloy. Also, it must have a higher solubility at temperatures above the liquidus temperature of the feedstock alloy than it does at temperatures below the solidus temperature of the alloy.

Also, if hydrogen is used to inflate the particles, it is not necessary that it be generated by the dissociation of water in the plasma arc. Atomic hydrogen can also be produced by dissociating molecular hydrogen in an electric arc or by introducing hydrogen gas into the plasma. If water is not used, the ambient atmosphere may furnish the oxygen necessary for the glass forming reactions.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patent is:

1. A method of forming hollow, metallic microballoons having high surface integrity which comprises the steps of: preparing a finely divided feedstock powder with a specified range of particle sizes from a self-scavenging metallic alloy which exhibits high fluidity and a high liquid film strength and which undergoes a minimal volume change and is favorable to the formation of a smooth surface topography upon solidification; introducing said powder into a plasma arc to melt the particles of said powder; making available in said arc a gas which can diffuse into and inflate the molten particles into hollow microballoons; and solidifying and collecting said microballoons.

2. A method as defined by claim 1 in which the metallic feedstock alloy powder is prepared by melting and atomizing the alloy and then collecting the particles formed in the atomizing step, all of the aforesaid steps being carried out in an atmosphere which is inert relative to the alloy under the process conditions.

3. A method as defined in claim 2 together with the step of screening from the collected particles those which do not fall in the range of about 100 to 400 mesh.

4. A method as defined in claim 1 in which the alloy from which the finely divided powder is prepared comprises a base material which is a metal or combination of metals capable of absorbing hydrogen in its molten state and of desorbing said hydrogen as it solidifies.

5. A method as defined in claim 4 in which said base material is nickel or a nickel-manganese alloy.

6. A method as defined in claim 5 in which the alloy also includes one or more elements selected from the group consisting of iron, cobalt, chromium, aluminum, beryllium, molybdenum, and columbium.

7. A method as defined in claim 1 in which the alloy contains a glass forming element selected from those having a free energy of formation per gram-atomic weight of oxygen which is lower than that of hydrogen per gram-atomic weight of oxygen.

8. A method as defined in claim 1 in which the glass forming element is boron, silicon, arsenic, germanium, or phosphorous; a compound of one of the aforesaid elements; or a combination of two or more of the foregoing elements or compounds.

9. A method as defined in claim 8 in which the glass forming element includes at least one fluoride.

10. A method as defined in claim 1 in which the alloy from which the finely divided powder is made has the nominal composition:

| Element | Percent by Weight |
|---|---|
| Ni | 68–76 |
| Mn | 21–27 |
| Si | 2.4–3.2 |
| B | 1.1–1.4 |
| Cb | trace–0.5 |

11. A process as defined in claim 1 in which water is introduced into the plasma for dissociation thereby to furnish nascent hydrogen for absorption by and inflation of the particles of finely divided powder and nascent oxygen which can react with the glass forming element or elements present in the metallic alloy to form impermeable glassy coatings on the inflated particles.

12. A method as defined in claim 1 characterized in that the gas made available for diffusion into the molten particles of metallic alloy is one which will not react deleteriously with base constitutents of the alloy under the process conditions and in that said gas is more soluble in said alloy at temperatures above the liquidus temperature of the alloy than it is at temperatures below the solidus temperature of the alloy.

13. A method as defined in claim 1 in which the gas is made available by introducing it into the plasma flame.

14. A method as defined in claim 1 wherein the inflated molten particles are solidified by free fall through a gas stream to quench and thereby rapidly reduce their temperature and to protect them against physical damage.

15. A method as defined in claim 1 in which the alloy from which the finely divided powder is prepared comprises a base material which is a metal or combination of metals capable of absorbing hydrogen in its molten state and of desorbing said hydrogen as it solidifies, said alloy also containing a glass forming element selected from those having a free energy of formation per gram-atomic weight of oxygen which is lower than that of hydrogen per gram-atomic weight of oxygen.

16. A method as defined in claim 15 in which said base material is nickel or a nickel-manganese alloy and the glass forming element is boron, silicon, arsenic, germanium, or phosphorous; a compound of one of the aforesaid elements; or a combination of two or more of the foregoing elements or compounds.

17. A hollow metal microballoon produced by the process of claim 1 which has a metallic shell overcoated with a glass film.

18. Hollow, metallic microballoons having high surface integrity and produced by preparing a finely divided feedstock powder with a specified range of particle sizes from a self-scavenging metallic alloy which has the nominal composition:

| Element | Percent by Weight |
|---|---|
| Ni | 68–76 |
| Mn | 21–27 |

-continued

| Element | Percent by Weight |
|---|---|
| Si | 2.4–3.2 |
| B | 1.1–1.4 |
| Cb | trace–0.5 |

introducing said powder into a plasma arc to melt the particles of said powder; making available in said arc a gas which can diffuse into and inflate the molten particles into hollow microballoons; and solidifying and collecting said microballoons.

19. A microballoon as defined in claim 18 in which the metallic alloy has the nominal composition Ni-21Mn-2.4Si-1.4B-trace Cb.

20. A hollow metal microballoon produced by the process of claim 1 from an alloy comprising at least one glass former and a base material that is capable of absorbing hydrogen.

21. A hollow metal microballoon produced by the process of claim 1 from an alloy which undergoes minimal volume change during solidification; which has a short temperature solidification range; and which, in the molten state, has high fluidity and a high liquid film strength.

* * * * *